US007545286B2

(12) United States Patent
Yanase

(10) Patent No.: US 7,545,286 B2
(45) Date of Patent: Jun. 9, 2009

(54) SELF-PROPELLED VEHICLE SAFETY URGING SYSTEM, SELF-PROPELLED VEHICLE SAFETY URGING METHOD, AND SAFETY URGING INFORMATION PROCESSING PROGRAM

(75) Inventor: Kazuhiro Yanase, Tokyo (JP)

(73) Assignee: NEC Corporation, Tokyo (JP)

( * ) Notice: Subject to any disclaimer, the term of this patent is extended or adjusted under 35 U.S.C. 154(b) by 308 days.

(21) Appl. No.: 11/657,232

(22) Filed: Jan. 24, 2007

(65) Prior Publication Data

US 2007/0182588 A1 Aug. 9, 2007

(30) Foreign Application Priority Data

Feb. 6, 2006 (JP) ..... 2006-028128

(51) Int. Cl.
*G08G 1/09* (2006.01)

(52) U.S. Cl. ..... 340/905; 340/995.13

(58) Field of Classification Search ..... 340/905, 340/988, 991, 928, 995.13; 701/117, 119; 455/404.1

See application file for complete search history.

(56) References Cited

U.S. PATENT DOCUMENTS 5,289,183 A * 2/1994 Hassett et al. ..... 340/905
5,315,295 A * 5/1994 Fujii ..... 340/936
5,815,802 A * 9/1998 Loechner, II ..... 455/414.1
7,382,274 B1 * 6/2008 Kermani et al. ..... 340/901
7,397,390 B2 * 7/2008 DiPiazza ..... 340/905
2001/0020902 A1 * 9/2001 Tamura ..... 340/905

FOREIGN PATENT DOCUMENTS

| | | |
|---|---|---|
| JP | 03-175749 | 7/1991 |
| JP | 04-299379 | 10/1992 |
| JP | 11-094574 | 4/1999 |
| JP | 2002-163788 | 6/2002 |
| JP | 2002-243469 | 8/2002 |
| JP | 2002-260034 | 9/2002 |
| JP | 2004-198997 | 7/2004 |
| JP | 2005-149402 | 6/2005 |
| JP | 2005-337963 | 12/2005 |

* cited by examiner

*Primary Examiner*—Brent Swarthout
(74) *Attorney, Agent, or Firm*—Scully, Scott, Murphy & Presser, P.C.

(57) ABSTRACT

Information to urge safety driving is outputted to a driver in dangerous areas including intersections. When a vehicle reaches near an intersection, an on-vehicle system refers to communication availability information previously stored by using a car navigation system, and recognizes whether on-vehicle communication equipment is capable of communicating with roadside communication equipment. If it is recognized that the on-vehicle communication equipment is not capable of communicating with the roadside communication equipment based on information from the car navigation system, it outputs an instruction to output safety urging information to an output device, and the output device outputs safety urging information corresponding thereto.

12 Claims, 13 Drawing Sheets

FIG. 2

| INTERSECTION No | ROAD-VEHICLE COMMUNICATION FLAG | SIGNAL FLAG |
|---|---|---|
| • | • | • |
| • | • | • |
| • | • | • |
| INTERSECTION 300 | 0 | 0 |
| INTERSECTION 301 | 1 | 1 |
| INTERSECTION 302 | 0 | 0 |
| • | • | • |
| • | • | • |
| • | • | • |

FIG. 8

| INTERSECTION No | ROAD-VEHICLE COMMUNICATION FLAG | SIGNAL FLAG |
|---|---|---|
| • | • | • |
| • | • | • |
| • | • | • |
| INTERSECTION 300 | 1 | 0 |
| INTERSECTION 301 | 0 | 0 |
| INTERSECTION 302 | 0 | 1 |
| • | • | • |
| • | • | • |
| • | • | • |

FIG. 13

| INTERSECTION No | ROAD-VEHICLE COMMUNICATION FLAG | SIGNAL FLAG | • • • | NUMBER OF TIMES |
|---|---|---|---|---|
| • | • | • | • | • |
| • | • | • | • | • |
| • | • | • | • | • |
| INTERSECTION 300 | 0 | 0 | • • • | 11 |
| INTERSECTION 301 | 1 | 0 | • • • | 14 |
| INTERSECTION 302 | 0 | 1 | • • • | 0 |
| • | • | • | • | • |
| • | • | • | • | • |
| • | • | • | • | • |

SELF-PROPELLED VEHICLE SAFETY URGING SYSTEM, SELF-PROPELLED VEHICLE SAFETY URGING METHOD, AND SAFETY URGING INFORMATION PROCESSING PROGRAM

BACKGROUND OF THE INVENTION

1. Field of the Invention

The present invention relates to a safety urging system for a self-propelled vehicle, a safety urging method for a self-propelled vehicle, and an information processing program for urging safety, for outputting information to urge a driver to drive safely in communication areas, based on travel information indicating the states of vehicles traveling communication areas including intersections transmitted from roadside communication equipment.

2. Description of Related Art

In order to prevent collision with other vehicles or pedestrians approaching from different directions when a vehicle reaches near a blind intersection, there has been provided a road-vehicle communication system to alert the driver of such a situation, conventionally. The conventional road-vehicle communication system includes on-vehicle communication equipment provided to a vehicle and roadside communication equipment provided to near intersections or high accident areas. It is so configured that when vehicles or pedestrians are approaching from different directions at intersections, the on-vehicle communication equipment wirelessly obtains approaching information transmitted from the roadside communication equipment. Note that the conventional road-vehicle communication system is not used in every road, and even in roads where it is used, the system is not used in every intersection.

The conventional road-vehicle communication system described above is used at intersections in a mixed manner. Therefore, in this system, drivers get used to the services in roads where the system is used frequently, so if there is no alarm at intersections where it is not used, drivers mistakenly believe that safety is secured. This causes a problem of lack of proper attention to safety driving.

Further, in the conventional road-vehicle communication system, on-vehicle communication equipment provided to a vehicle is always activated in order to receive information to urge safety driving at intersections, so a problem of waste in power consumption has been caused.

On the other hand, no prior publication has been found for art solving the problems described above at present. As art close thereto (art utilizing the road-vehicle communication system), a drive supporting device providing, to drivers, information about capability of overtaking or appropriateness of overtaking is disclosed (for example, refer to Japanese Patent Laid-Open Publication No. 2005-149402 (Patent Document 1)). Further, an on-vehicle map display device which displays congested roads accurately by clearly indicating whether the road is monitored for traffic congestion is disclosed (for example, refer to Japanese Patent Laid-Open Publication No. 04-299379 (Patent Document 2)).

However, the device of Patent Document 1 (driver supporting device), among the known art, is one which provides information about capability of overtaking and appropriateness of overtaking to a driver, and is not to prevent collisions when two vehicles met at intersections. Further, the device of Patent Document 2 (on-vehicle map display device) is for displaying congested roads accurately by clearly indicating whether the road is monitored for congestion, and is not intended to prevent accidents such as collisions when two vehicles met at intersections.

SUMMARY OF THE INVENTION

In view of the problems described above, it is an object of the present invention to provide a safety urging system for a self-propelled vehicle, a safety urging method for a self-propelled vehicle, and an information processing program for urging safety, intended to be able to securely output information for alerting the driver of the own vehicle traveling every intersection and area considered as dangerous so as to effectively prevent an accident.

In order to achieve the object, a safety urging system for a self-propelled vehicle according to the present invention includes: an on-vehicle communication unit which communicates with roadside communication equipment provided in a predetermined communication area including an intersection on a road, and inputs information relating to traffic condition in the communication area; a safety urging information output unit which outputs information to urge the driver of the own vehicle to drive safely, based on the information obtained by the on-vehicle communication unit; and an on-vehicle computation controller which controls operations of the safety urging information output unit and the on-vehicle communication unit.

The safety urging system for a self-propelled vehicle further includes a communication availability information storing unit which stores communication availability information indicating whether communication by the on-vehicle communication unit with the roadside communication equipment is possible, together with map information including the communication area.

Further, the on-vehicle computation controller includes: a communication availability recognizing function, activated when the own vehicle reaches near the communication area, to determine whether communication between the on-vehicle communication unit and the roadside communication equipment is possible based on communication availability information; and an operation instruction output function, activated when communication with the roadside communication equipment is impossible, to send an operation instruction to the safety urging information output unit.

Therefore, according to the present invention, in an area where communication with roadside communication equipment is possible, travel conditions of the area can be obtained beforehand. Therefore, the driver can prepare for driving safely. On the other hand, even in the case where communication with roadside communication equipment is impossible, it is possible to realize outputting prescribed safety urging information to the driver in the communication area, based on communication availability information stored on the communication availability information storing unit by the computation control function of the on-vehicle computation controller. Therefore, safety urging information is outputted to a driver in any situation, so when the vehicle is entering a communication area such as an intersection, the driver has been able to grasp the situation beforehand or the driver has prepared for paying attention to safety. In such a point, the driver can realize safe driving comfortably.

Further, if communication with the roadside communication equipment is impossible, the on-vehicle computation controller is activated immediately and outputs safety urging information from the safety urging information output unit to the driver of the own vehicle, as described above. Thereby, since the state of a dangerous area such as an intersection, which is the destination, is unknown, the driver of the own vehicle further concentrates on safe driving, whereby in traveling dangerous areas including all intersections, there is an advantage that vehicle travel concentrating on confirming safety can be realized.

The communication area may be a predetermined range on a road including an intersection. Further, the communication availability information storing unit may be configured of a car navigation system having a communication availability information storing function, in which various pieces of information provided in the car navigation system are utilized effectively by associating with the on-vehicle computation controller.

Further, if information indicating travel conditions received from the roadside communication equipment by the on-vehicle communication unit is information indicating that an object to be a factor of urging safety driving exists near a communication area including an intersection, the on-vehicle computation controller may be configured to include an operation instruction output function to output an operation instruction to output the safety urging information to the safety urging information output unit.

Therefore, according to this aspect, it is possible to activate the safety urging information output unit based on information from the roadside communication equipment, so even in the case where the communication availability information storing unit or the communication availability information storing function does not work effectively, safety urging information can be outputted to the driver based on information from the roadside communication equipment. Therefore, outputting of urging information to confirm safety is provided in two ways, so it is possible to transmit optimum safety urging information to the driver securely and effectively.

Further, the on-vehicle computation controller includes: a stand-by instruction output function (stand-by start instruction output unit), activated when the vehicle reaches near an intersection, to output an instruction to set to be in a stand-by state before starting communication between the on-vehicle communication unit and the roadside communication equipment. Further, the controller may include a stand-by state releasing function (stand-by release instruction output unit) to, when a communication impossible state is caused with the roadside communication equipment, activate the operation instruction output function (safety urging information instruction output unit) so as to output an operation instruction (to output the safety urging information) to the output device (safety urging information output unit), and to release the stand-by state of the on-vehicle communication equipment so as to restore to a state before stand-by.

With this configuration, it is possible to automatically activate the on-vehicle communication unit only when needed, so the on-vehicle communication unit is not always required to be activated. Thereby, it is possible to reduce the power consumption of the on-vehicle communication unit, and consequently, to effectively save energy consumption of the device as a whole. This provides an advantage that the durability of the device as a whole can be enhanced significantly.

Further, for communication with the roadside communication equipment, the on-vehicle computation controller may have a communication state update function to update the communication availability information and the like stored on the communication availability information storing unit to a new communication state between the on-vehicle communication unit and the roadside communication equipment, if a communication state including communication availability between the on-vehicle communication unit and the roadside communication equipment newly recognized by the communication availability information storing unit or the car navigation system is different from a communication state including communication availability, previously set, between the on-vehicle communication unit and the roadside communication equipment.

With this configuration, it is possible to surely eliminate an inconvenience such as roadside communication equipment not working even though it exists. In such a point, it is possible to enhance reliable relationship between the driver and the system, whereby the driver's reliance on information from the roadside communication equipment and to the system is increased, so the efficiency of safety driving can be surely improved.

Further, a safety urging method for a self-propelled vehicle, according to the present invention, includes: a first step to take information about travel conditions in a predetermined communication area (e.g., intersection) on a road where a vehicle travels, from a roadside communication equipment set in the communication area into an on-vehicle communication unit previously mounted in the own vehicle; and a second step to output a prescribed safety urging information to a driver of the own vehicle, based on traffic information obtained from the roadside communication equipment or information previously set separately.

Further, the method includes a communication availability recognition step in which before the first step is carried out, the on-vehicle communication unit is activated when the own vehicle reaches near the communication area, and the on-vehicle computation controller, previously mounted, determines whether the on-vehicle communication unit is capable of communicating with the roadside communication equipment with reference to communication availability information stored on a communication availability information storing unit (car navigation system) previously mounted. Further, the method includes an operation instruction output step in which before or after the first step is carried out, if it is determined that communication with the roadside communication equipment is impossible, the on-vehicle computation controller is activated so as to send an operation instruction to output safety urging information to the safety urging information output unit previously mounted.

Therefore, according to the present invention, in an area where communication with the roadside communication equipment is possible, travel conditions of the area can be obtained beforehand, or in a state where communication is impossible or before performing communication, prescribed safety urging information is outputted to the driver in the communication area based on communication availability information stored on the communication availability information storing unit. Thereby, safety urging information is outputted to the driver effectively in any state. Accordingly, when entering a communication area such as an intersection, the driver has grasped the conditions at real time beforehand or has prepared for safety. In such a point, the driver can realize safety driving comfortably.

Further, the method includes: a stand-by instruction output step in which the on-vehicle computation controller is activated when the own vehicle reaches near the communication area before the first step is carried out so as to output an instruction to set the on-vehicle communication unit to be in a stand-by state which is a state before starting communication with the roadside communication equipment; and a stand-by state releasing step (stand-by release instruction output unit for outputting an instruction) in which before or after the first step is carried out, if it is determined that communication with the roadside communication equipment is impossible, the on-vehicle computation controller is activated so as to carry out the second step and to release the stand-by state of the on-vehicle communication unit to thereby restore to a state before stand-by.

With this configuration, it is possible to achieve operational effect similar to that of the safety urging method for a self-propelled vehicle described above without communicating with the roadside communication equipment, whereby information processing time is shorten, so responsiveness is improved since communication is not performed with the roadside communication equipment. Further, this provides an advantage that power consumption of the on-vehicle communication unit can be reduced.

The method may include: a communication state determination step in which an on-vehicle computation controller, mounted separately, determines whether a communication state including communication availability taken in the first step is different from a communication state including communication availability between the on-vehicle communication unit and the roadside communication equipment stored on a communication availability information storing unit previously mounted; and a communication state update step which is activated when the communication state taken in the first step is determined as being different from the communication state previously set so as to update the communication availability information and the like stored on the communication availability information storing unit to the communication state taken in the first step.

With this configuration, inconvenience such as roadside communication equipment not working even though it exists can be surely eliminated beforehand, and the information accuracy is improved, so reliability with respect to the safety urging information outputted, by the driver, can be further improved. Thereby, safety driving by the driver is realized effectively.

Further, an information processing program for urging safety, according to the present invention, is configured to cause a computer to execute: travel information obtainment processing to take information about travel conditions in a predetermined communication area including an intersection on a road where a vehicle travels, from roadside communication equipment set in the communication are into an on-vehicle communication unit previously mounted in the own vehicle; urging information output processing to output prescribed safety urging information to a driver of the own vehicle, based on traffic information obtained from the roadside communication equipment or information previously set separately; communication availability recognition processing which is activated when the own vehicle reaches near the communication area before the travel information obtainment processing is executed, and determines whether the on-vehicle communication unit is capable of communicating with the roadside communication equipment with reference to communication availability information stored on a communication availability information storing unit previously mounted; and operation instruction output processing to send an operation instruction to a safety urging information output unit, previously mounted, to output safety urging information, if it is determined that communication with the roadside communication equipment is impossible.

Therefore, according to the present invention, even communication with the roadside communication equipment is impossible or before performing communication, it is possible to output prescribed safety urging information to the driver based on communication availability information stored on the communication availability information storing unit. Therefore, it is possible to output safety urging information effectively, speedy and securely to the driver in any situation. In such a point, the driver can perform safety driving comfortably.

Further, the program may include, and cause a computer to execute: stand-by instruction output processing which is operated when the own vehicle reaches near the communication area so as to output an instruction to set the on-vehicle communication unit to be in a stand-by state which is a state before starting communication with the roadside communication equipment; and stand-by state release processing to output an instruction to release the stand-by state of the on-vehicle communication unit if it is determined that communication with the roadside communication equipment is impossible, to thereby restore to a state before stand-by.

With this configuration, it is possible to reduce information processing time and to improve responsiveness. Further, power consumption of the on-vehicle communication unit can be reduced securely.

Further, the program may include and cause a computer to execute: communication state determination processing to determine whether a communication state including communication availability processed in the travel information obtainment processing is different from a communication state including communication availability between the on-vehicle communication unit and the roadside communication equipment stored on a communication availability information storing unit previously mounted; and communication state update processing which is activated when the communication state is determined as being different from the communication state, previously set, by the communication state determination processing so as to update the communication availability information and the like stored on the communication availability information storing unit (car navigation system) to the communication state processed in the travel information obtainment processing.

With this configuration, inconvenience of not working even though the roadside communication equipment exists can be surely eliminated from the car navigation system for example. Further, information accuracy about presence or absence of operation of the roadside communication equipment is improved, so reliability with respect to the safety urging information outputted, by the driver, can be further increased, so safety driving by the driver can be realized effectively.

EFFECTS OF THE INVENTION

According to the present invention, in traveling a travel dangerous area including an intersection, safety urging information can be outputted to the driver at any time. Further, even when communication with the roadside communication equipment is impossible, the safety urging information can be outputted based on communication availability information stored previously. Therefore, the driver can recognize the presence of a dangerous area beforehand, so the driver will drive safely in the travel dangerous area consciously at any time. At the same time, since the operating state of the on-vehicle communication unit is limited effectively, it is possible to achieve such an excellent effect that power consumption by the on-vehicle communication equipment and also the power consumption of the whole system can be suppressed effectively, which has not been achieved conventionally.

BRIEF DESCRIPTION OF THE DRAWINGS

FIG. 2 is an illustration showing intersection data stored on the communication availability information storing unit (car navigation system having a communication availability information storing function) shown in FIG. 1;

FIG. 8 is an illustration showing intersection data used in FIG. 6;

FIG. 13 is an illustration showing management map information data of the third embodiment disclosed in FIG. 12.

DESCRIPTION OF PREFERRED EMBODIMENTS

In the followings, embodiments of the present invention will be described by referring to the accompanying drawings.

First Embodiment

Figure 1:
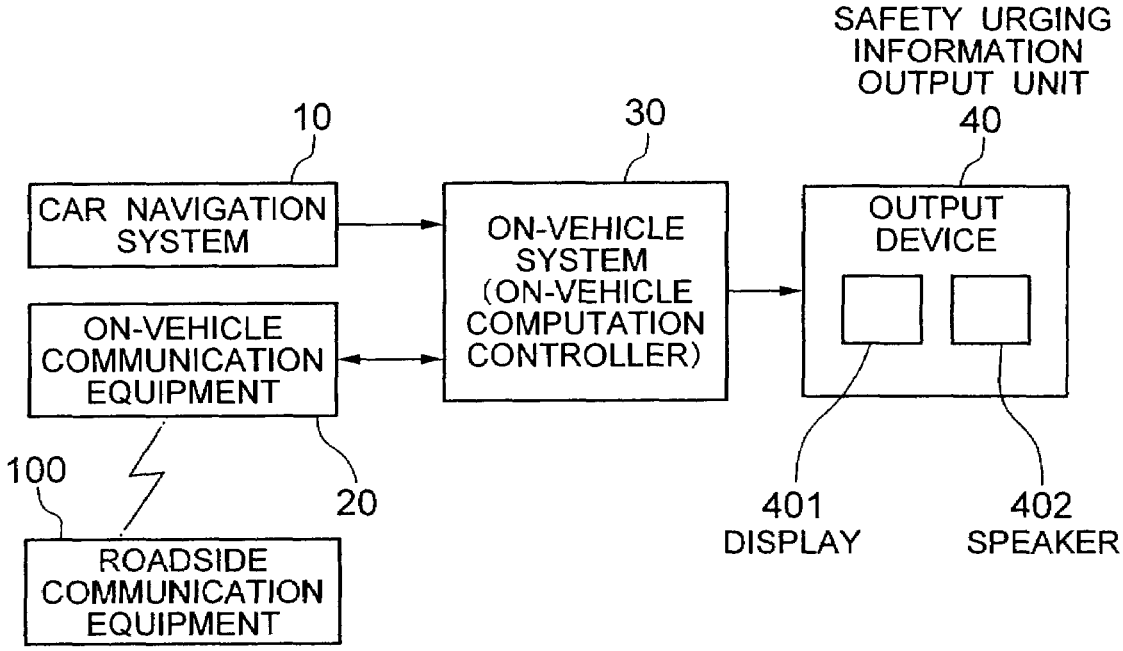
FIG. 1 is a block diagram showing a first embodiment according to the present invention.

FIG. 1 is a block diagram showing the configuration of a safety urging system for a self-propelled vehicle in a first embodiment. In FIG. 1, the safety urging system for a self-propelled vehicle includes: roadside communication equipment 100 provided in a predefined communication area (e.g., area including an intersection) on a road; on-vehicle communication equipment 20 serving as an on-vehicle communication unit which communicates with the roadside communication equipment 100 so as to input information about traffic conditions in the communication area; an output device 40 serving as a safety urging information output unit which outputs information for urging the driver of the vehicle to drive safely, based on the information obtained by the on-vehicle communication equipment 20; and an on-vehicle system 30 serving as a on-vehicle computation controller which controls operations of the output device (safety urging information output unit). 40 and the on-vehicle communication equipment 20.

Further, the safety urging system for a self-propelled vehicle includes a car navigation system 10 having a communication availability information storing function, serving as a communication availability information storing unit, which previously stores communication availability information indicating whether the on-vehicle communication equipment 20 is capable of communicating with the roadside communication equipment 100, together with map information including the communication area.

Further, the on-vehicle system (on-vehicle computation controller) 30 includes a communication availability recognizing function (communication availability recognition unit) which is activated when the own vehicle reaches near the communication area, and based on communication availability information provided in the car navigation system 10, determines whether communication between the on-vehicle communication equipment 20 and the roadside communication equipment 100 is possible. The on-vehicle system 30 further includes an operation instruction output function which is activated when communication with the roadside communication equipment 100 is impossible, and sends an operation instruction for causing the output device (safety urging information output unit 40) to output safety urging information.

Further, the on-vehicle system (on-vehicle computation controller) 30 includes an operation instruction output function which gives an operation instruction to the output device 40 serving as the safety urging information output unit when the information showing the travel conditions received from the roadside communication equipment 100 is information indicating that an object constituting a factor to urge safety driving exists near the communication area including an intersection. Further, the on-vehicle system (on-vehicle computation controller) 30 includes: a stand-by instruction output function which is activated when the own vehicle reaches near an intersection, and outputs an instruction to the on-vehicle communication equipment 20 to set to a stand-by state before starting communication with the roadside communication equipment 100; and a stand-by state releasing function which activates the operation instruction output function when a communication impossible state is caused with the roadside communication equipment to thereby output an operation instruction to the output device 40 and also release the stand-by state of the on-vehicle communication equipment 20 to thereby restore to the state before stand-by.

Further, the on-vehicle system (on-vehicle computation controller) 30 includes a communication state update function which updates communication availability information and the like stored on the car navigation system (communication availability recognition unit) 10 to a new communication state between the on-vehicle communication equipment 20 and the roadside communication equipment 100, when the communication state including communication availability between the on-vehicle communication equipment 20 and the roadside communication equipment 100, newly recognized by the car navigation system (communication availability recognition unit) 10, is different from the previously set communication state including communication availability between the on-vehicle communication equipment 20 and the roadside communication equipment 100.

Hereinafter, they will be described further in detail.

The car navigation system 10 stores map information data on, for example, a CD-RW (CD-Rewritable, not shown) to which data can be written or read, and provides information such as present location display of the own vehicle, route search and route directions by using GPS (Global Positioning System). The map information data includes, as shown in FIG. 2, a road-vehicle communication flag indicating communication availability between the roadside communication equipment 100, provided to an intersection or near an intersection, and the on-vehicle communication equipment 20 (hereinafter referred to as "road-vehicle communication availability"), and a signal flag indicating presence or absence of a signal, and the like. Note that if the road-vehicle communication flag is "0", it indicates that communication between the road-vehicle communication equipment 20 and the road side communication equipment 100 is impossible, and if the road-vehicle communication flag is "1", it indicates communication is possible.

When the own vehicle is approaching an intersection, the car navigation system 10 refers to the road-vehicle communication flag, and outputs, to the on-vehicle system 30, information indicating whether the area near the intersection is an area where communication between the on-vehicle communication equipment 20 and the roadside communication equipment is possible (hereinafter referred to as "communication possible area") or impossible (hereinafter referred to as "communication impossible area). Further, the car navigation system 10 updates the road-vehicle communication flag of the corresponding intersection written on the map information data in accordance with an instruction (command), described later, outputted from the on-vehicle system (on-vehicle computation controller) 30.

Namely, the on-vehicle communication equipment 20 is communication equipment having a function of, when an instruction to cause the on-vehicle communication equipment 20 to be in a stand-by state (hereinafter referred to as "stand-by start instruction") is inputted from the on-vehicle system 30, following the instruction and obtaining information indicating the travel conditions (hereinafter referred to as "travel condition information") near the intersection from the roadside communication equipment 100 wirelessly.

Note that the on-vehicle communication equipment 20 has a function of transmitting a communication error to the on-vehicle system 30 if there is no roadside communication equipment 100 even when a stand-by start instruction is given from the on-vehicle system 30. Further, irrespective of a communication start instruction from the on-vehicle system 30 being given, the on-vehicle communication equipment 20 has a function of transmitting travel condition information transmitted from the roadside communication equipment 100 to the on-vehicle system 30 if it is obvious that the roadside communication equipment 100 exists as a result of communicating with the roadside communication equipment 100. Moreover, when an instruction to release a stand-by state (hereinafter referred to as "stand-by release instruction") is inputted from the on-vehicle system 30, the on-vehicle communication equipment 20 follows the release instruction to thereby release the stand-by state.

The on-vehicle system (on-vehicle computation controller) 30 has a function as an information processor, and when information indicating that the vehicle is approaching an intersection and information indicating that the area near the intersection is a communication possible area or the area is a communication impossible area are inputted from the car navigation system 10, it output a stand-by start instruction to the on-vehicle communication equipment 20 thereafter. Further, if information indicating that the area near the intersection is a communication impossible area is inputted from the car navigation system 10, the on-vehicle system 30 outputs an instruction to cause the output device 40 to output information for urging the driver to drive safely (hereinafter referred to as "safety drive urging information"). Further, after outputting the instruction, the on-vehicle system 30 outputs a stand-by release instruction to the on-vehicle communication equipment 20.

Further, if the on-vehicle communication equipment 20 could not communicate with the roadside communication equipment 100 even though information indicating that the area near the intersection is a communication possible area was inputted from the car navigation system 10, the on-vehicle system 30 outputs an instruction to update the road-vehicle communication flag of the corresponding intersection in the map information data stored on the car navigation system 10 from "1" to "0". Further, if the on-vehicle communication equipment 20 could communicate with the roadside communication equipment 100 even though information indicating that the area near the intersection is a communication impossible area was inputted from the car navigation system 10, the on-vehicle system 30 outputs an instruction to update the road-vehicle communication flag of the corresponding intersection in the map information data stored on the car navigation system 10 from "0" to "1".

The output device (safety urging information output unit) 40 is an output device including human-machine interfaces such as a display 401 and a speaker 204, having a function of outputting safety drive urging information by means of an alarm display and an alarm to the driver in accordance with instructions from the on-vehicle system 30.

Next, operation of the first embodiment will be described based on FIGS. 3 to 8.

Here, a safety urging method for a self-propelled vehicle and an information processing program for urging safety, according to the present invention, will also be described together.

Figure 3:
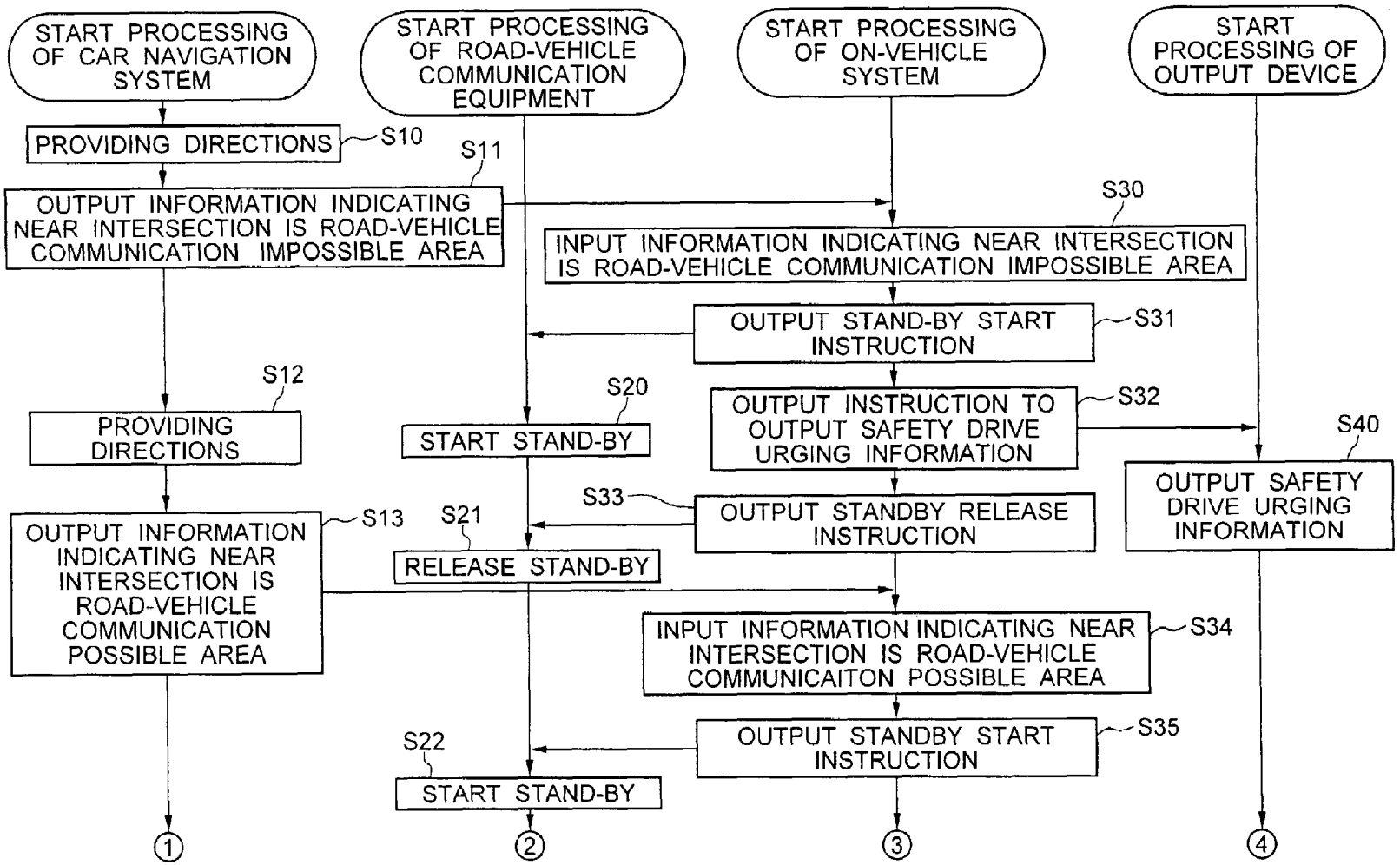
FIG. 3 is a flowchart showing operating timings of the respective units of the first embodiment disclosed in FIG. 1.
Figure 4:
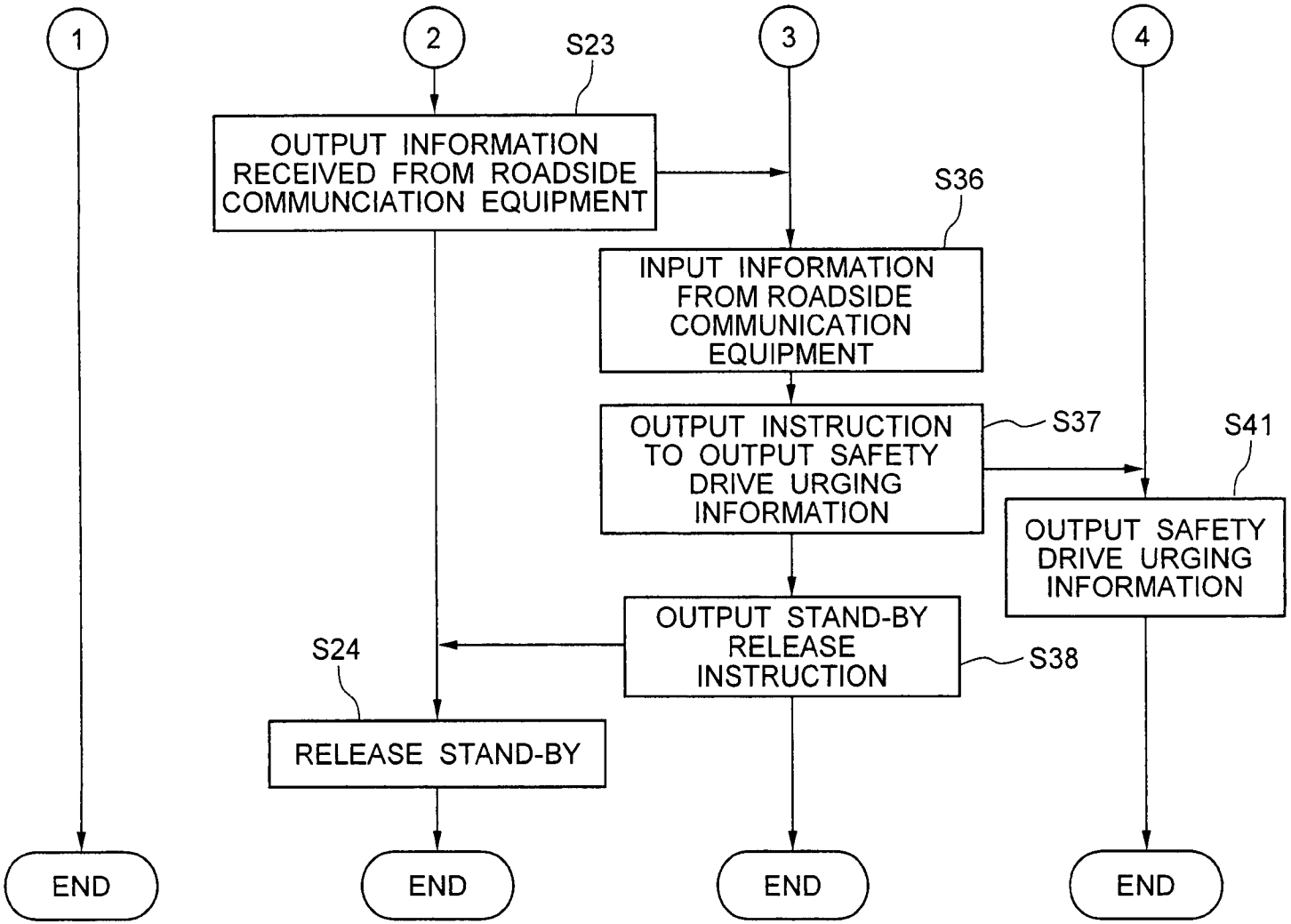
FIG. 4 is a flowchart showing operating timings of the respective units of the first embodiment continued from FIG. 3.
Figure 5:
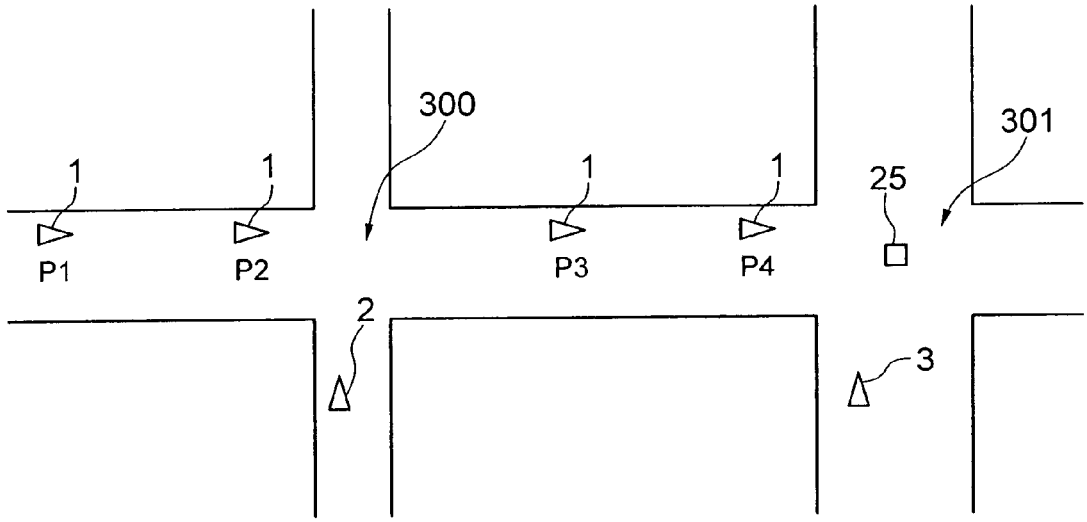
FIG. 5 is an illustration for explaining the operation of the first embodiment disclosed in FIG. 1, explaining a traveling states on a road.

First, FIGS. 3 and 4 show flowcharts indicating operation timings among various elements of the safety urging system for a self-propelled vehicle in the case of not updating map information data. In this case, it is assumed that an automobile as a vehicle (hereinafter referred to as "own car") 1 travels a route of P1 to P2 to P3 to P4, as shown in FIG. 4, and P4 is in a road-vehicle communication possible area. Further, it is also assumed that another car 2 is approaching an intersection 300, and another car 3 is approaching the next intersection 301.

First, when the own car 1 is at P1, the car navigation system 10 displays route directions or the present location of the own car 1, based on the route search result previously set by the driver (step S10). Then, when the own car 1 moves to the intersection 300 and reaches a position having a prescribed distance from the intersection 300, the car navigation system 10 reads out the road-vehicle communication flag "0" of the intersection 300 from the map information data, and based on the flag "0", it detects that the area near the intersection 300 is a road-vehicle communication impossible area. Then, the car navigation system 10 outputs information indicating that the own car is approaching the intersection 300 and the area near the intersection 300 is a communication impossible area, to the on-vehicle system 30 (step S11).

When information indicating that the own car 1 is approaching the intersection 300 and that the area near the intersection 300 is a communication impossible area is inputted from the car navigation system 10, the on-vehicle system 30 recognizes that the area near the intersection 300 is a road-vehicle communication impossible area (step S30: communication availability recognition step), and at the same time, it outputs a stand-by start instruction to the on-vehicle communication equipment 20 (step S31: stand-by instruction output step).

In accordance with the stand-by start instruction inputted from the on-vehicle system 30, the on-vehicle communication equipment 20 becomes a stand-by state (step S20). Since the area near the intersection 300 is a communication impossible area, the on-vehicle communication equipment 20 will not start communication with the roadside communication equipment 100 actually.

The on-vehicle system 30 recognizes, with information from the on-vehicle communication equipment 20, that information from the roadside communication equipment 100 is not inputted even though a prescribed time has elapsed after the stand-by start instruction was outputted (first step), and causes the display 401 to display safety drive urging information to the driver when the own car 1 reaches the point P2 closer to the intersection 300, and outputs a sound output instruction from the speaker 402 to the output device 40 (step S32: operation instruction output step).

When the instruction is inputted from the on-vehicle system 30, the output device 40 follows the instruction to thereby display "Intersection ahead, take caution" for example on the display 401, and to output an alarm like "bleep" from the speaker 402 so as to urge the driver to drive safely (step S40, second step). Thereby, the driver is capable of driving at the intersection 300 while taking care of the other car 2 approaching from the crossing road.

After outputting the instruction, the on-vehicle system 30 outputs an instruction to release the stand-by state (hereinafter referred to as "stand-by release instruction) to the on-vehicle communication equipment 20 (step S33: stand-by release instruction output step).

In accordance with the stand-by release instruction inputted from the on-vehicle system 30, the on-vehicle communication equipment 20 releases the stand-by state (step S21: stand-by state release step)

Among the steps described above, it is acceptable to set the first step as travel information obtainment processing, in which information according to the travel conditions in the communication area such as an intersection previously set on the road where the vehicle travels is taken from the roadside communication equipment 100 provided in the communication area into the on-vehicle communication equipment 20 previously mounted in the own car 1, and set the second step as urging information output processing, in which prescribed safety urging information is outputted to the driver of the own car 1 based on the traffic information obtained from the roadside communication equipment 100 or information previously set differently, and set the communication availability recognition step as communication availability recognition processing, which is activated when the own car 1 reaches near the communication area before the execution of the travel information obtainment processing and in which it is determined whether the on-vehicle communication equipment 20 is capable of performing communication with the roadside communication equipment 100 by referring to the communication availability information stored on the previously mounted communication availability information storing unit (car navigation system) 10, and further, set the operation instruction output step as operation instruction output processing, in which an operation instruction to output safety urging information is sent to the previously mounted safety urging information output unit (output device) 40 when communication with the road-side communication equipment 100 is determined as impossible, which are configured to be programmed so as to be executed by a computer.

Then, the own car 1 passes the intersection 300 and moves to P3. During it, the car navigation system 10 displays route directions or the present location of the own car based on the route search result previously set by the driver (step S12). Then, when the own car 1 moves to the intersection 301 and reaches the place having a prescribed distance from the intersection 301, the car navigation system 10 reads out the road-vehicle communication flag "1" of the intersection 301 from the map information data, and based on the flag "1", recognizes that the area near the intersection 301 is a road-vehicle communication possible area, and outputs information indicating that the own car 1 is approaching the intersection 301 and the area near the intersection 301 is a communication possible area, to the on-vehicle system 30 (step S13). Through these steps, processing at the intersection 300 and the intersection 301 ends.

At the same time as the information that the own car 1 is approaching the intersection 301 and the area near the intersection 301 is a road-vehicle communication possible area being inputted from the car navigation system 10 (step S34), the on-vehicle system 30 outputs a stand-by instruction to the on-vehicle communication equipment 20 (step S35: stand-by instruction output step).

The on-vehicle communication equipment 20 transfers to be in a stand-by state in accordance with a stand-by instruction from the on-vehicle system 30 (step S22). When the own car 1 moves to P4 and enters the communication possible area, the on-vehicle communication equipment 20 receives, from the roadside communication equipment 25, information that the other car 3 is approaching from the crossing road at the intersection 301, and immediately outputs this information to the on-vehicle system 30 (step S23). At this time, if there is no vehicle or pedestrian, the on-vehicle communication equipment 20 will not transmit any information to the on-vehicle system 30.

When the on-vehicle system 30 receives, from the on-vehicle communication equipment 20, information that the other car 3 is approaching the intersection 301 (step S36), the on-vehicle system 30 displays safety driving urging information on the display 401 for the driver, and also outputs, to the output device 40, an instruction to output a sound from the speaker 402 (step S37). The output instruction includes information indicating the entering state of the other car 3 approaching the intersection, that is, information indicating that the vehicle is entering from the right direction for example.

When the instruction is inputted from the on-vehicle system 30, the output device 40 displays "Intersection ahead, car is approaching from right direction" for example on the display 401, and outputs an alarm like "bleep" from the speaker 402 (step S41) by following the instruction to thereby urge the driver to drive safely at the intersection 301, and ends processing at the intersection 300 and the intersection 301.

Then, the on-vehicle system 30 outputs a stand-by release instruction to the on-vehicle communication equipment 20 (step S38), and ends processing of the whole system at the intersection 300 and the intersection 301.

At the same time, the on-vehicle communication equipment 20 releases the stand-by state in accordance with the stand-by release instruction inputted from the on-vehicle system 30 (step S24: stand-by state releasing step), and ends processing at the intersection 300 and the intersection 301.

Note that it is acceptable to set the stand-by instruction output step as stand-by instruction output processing, in which the on-vehicle computation controller (on-vehicle system) 30 outputs an instruction to set the on-vehicle communication equipment 20 to be in a stand-by state before starting communication with the roadside communication equipment 100 when the own car reaches near an communication area such as an intersection, and set the stand-by state releasing step as stand-by state release processing, in which the stand-by state of the on-vehicle communication equipment 20 is restored to the state before stand-by when a communication impossible state is recognized with the roadside communication equipment 100, which are configured to be programmed so as to be executed by a computer.

Figure 6:
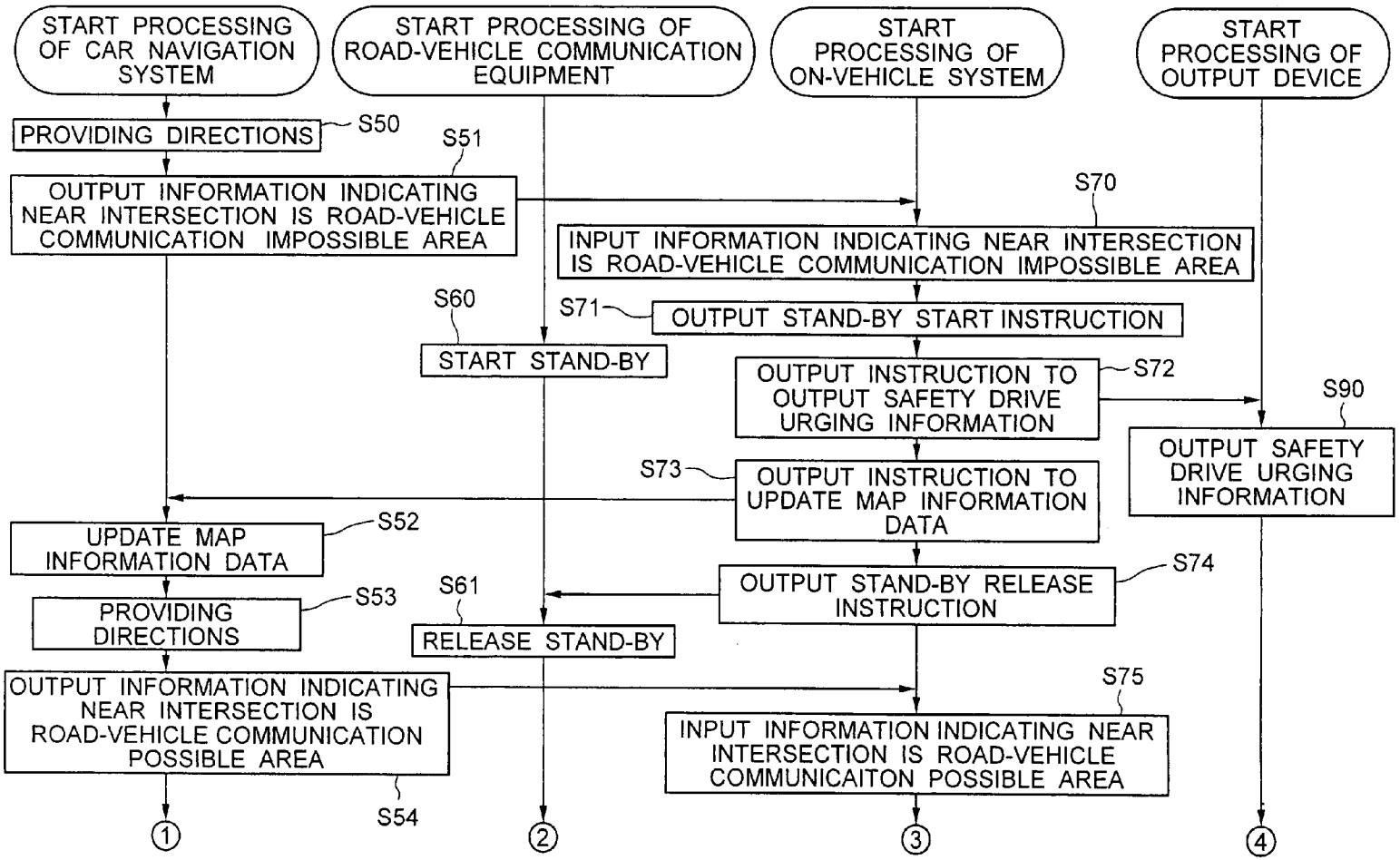
FIG. 6 is a flowchart showing an operation in the case of updating map information data in the first embodiment disclosed in FIG. 1.
Figure 7:
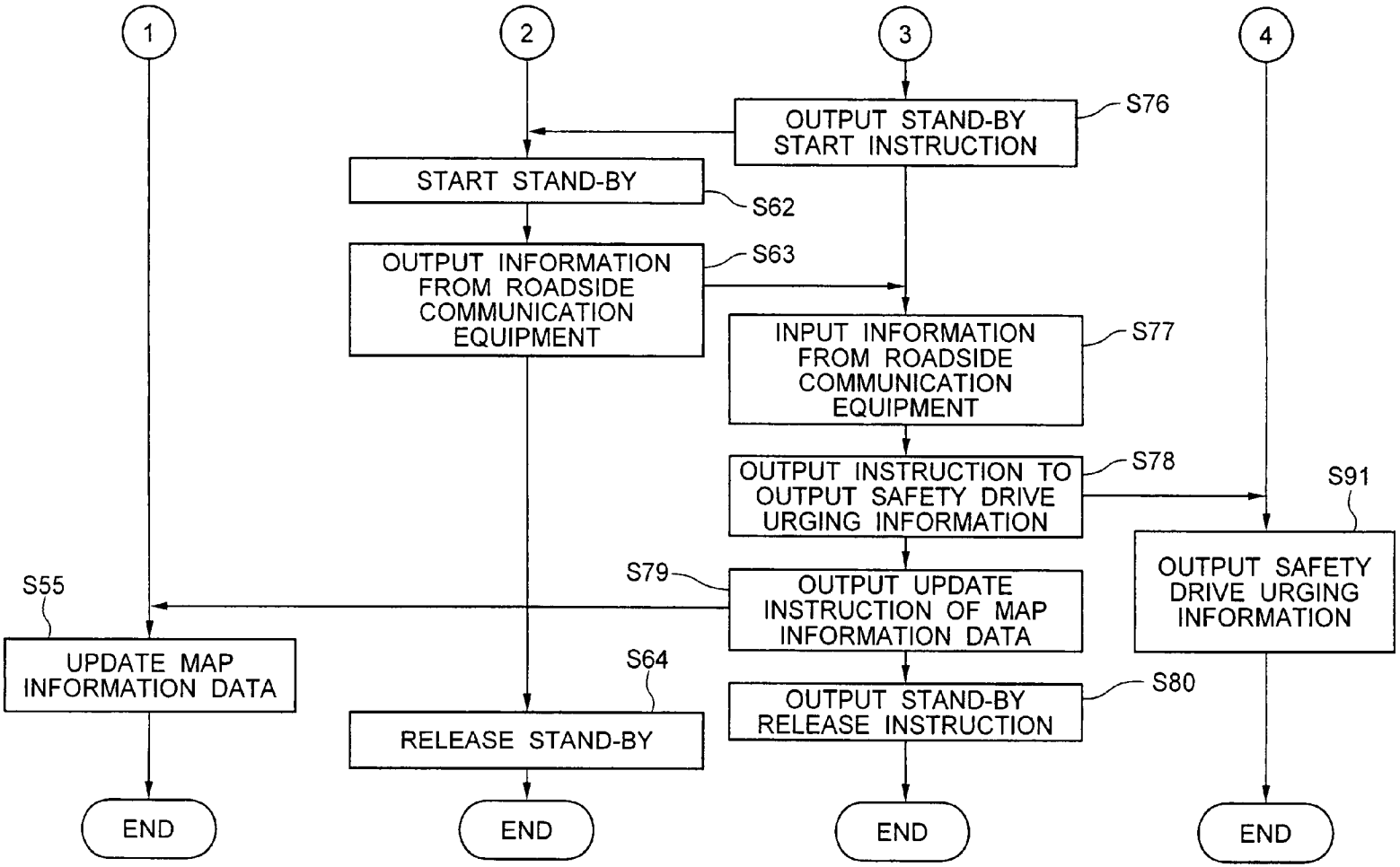
FIG. 7 is a flowchart showing operating timings of the respective units of the first embodiment continued from FIG. 6.

FIGS. 6 and 7 are flowcharts showing operation of the safety urging system for a traveling vehicle according to the first embodiment, in the case of updating the map information data.

As shown in FIG. 8, it is assumed that in the map information data stored on the car navigation system 10, the road-vehicle flag of the intersection 300 is set to "1", and the road-vehicle communication flag of the intersection 301 is set to "0", different from those shown in FIG. 4. Note that the data shown in FIG. 4 is assumed to be correct.

First, when the own car 1 is at P1, the car navigation system 10 displays route directions or the present location of the own car 1, based on the route search result previously set by the driver (step S50). Then, when the own car 1 moves to the intersection 300 and reaches a location having a prescribed distance from the intersection 300, the car navigation system 10 reads out the road-vehicle communication flag "1" of the intersection 300 from the map information data, and based on the flag "1", recognizes that the area near the intersection 300 is a communication possible area, and outputs information that it is approaching the intersection 300 and the area near the intersection 300 is a road-vehicle communication possible area, to the on-vehicle system 30 (step S51).

At the same time as the information that the own car 1 is approaching the intersection 300 and the area near the intersection 300 is a road-vehicle communication possible area being inputted from the car navigation system 10 (step S70), the on-vehicle system 30 outputs a stand-by instruction to the on-vehicle communication equipment 20 (step S71).

The on-vehicle communication equipment 20 transfers to be in a stand-by state in accordance with the stand-by instruction from the on-vehicle system 30 (step S60).

If any information from the roadside communication equipment 100 is not inputted from the on-vehicle communication equipment 20 even when a prescribed time has elapsed after outputting the stand-by instruction, the on-vehicle system 30 confirms the fact (communication state determination step), and when the own car 1 reaches the point P2 further closer to the intersection 300, the on-vehicle system 30 outputs, to the output device 40, an instruction to output safety drive urging information to the driver (step S72).

When such as instruction is inputted from the on-vehicle system 30, the output device 40 outputs "Intersection ahead, take caution" for example on the display 401, and outputs an alarm like "bleep" from the speaker 402, in accordance with the instruction, to thereby urge the driver to drive safely (step S90). Thereby, the driver can drive while watching the other car 2 approaching from the crossing road at the intersection 300.

Then, since the area near the intersection 300 is a communication impossible area, the on-vehicle system 30 outputs, to the car navigation system 10, an instruction to update the road-vehicle communication flag of the intersection 300 written on the map information data from "1" to "0" (step S73).

Based on the instruction inputted from the on-vehicle system 30, the car navigation system 10 updates the road-vehicle communication flag of the intersection 300 written on the map information data from "1" to "0" as shown in FIG. 4 (step S52: communication state update step).

Then, the on-vehicle system 30 outputs a stand-by release instruction to the on-vehicle communication equipment 20 (step S74).

The on-vehicle communication equipment 20 releases the stand-by state in accordance with the stand-by release instruction inputted from the on-vehicle system 30 (step S61).

Note that it is acceptable to set the communication state determination step as communication state determination processing, in which whether the communication state including communication availability processed in the travel information obtainment step is different from the communication state including the communication availability between the on-vehicle communication equipment 20 and the roadside communication equipment 100 stored on the communication availability information storing unit (car navigation system) 10 previously provided, and set the communication state update step as communication state update processing, which is activated when the communication state taken is determined as being different from the communication state previously set by such a determination and in which the communication availability information and the like stored on the communication availability information storing unit is updated to the communication state processed by the travel information obtainment processing, which are configured to be programmed so as to be executed by a computer.

Then, the own car 1 passes the intersection 300 and moves to P3.

During the period, the car navigation system 10 displays route directions or the present location of the own car 1 based on the route search result previously set by the driver (step S53). Then, when the own car 1 moves to the intersection 301 and reaches a location having a prescribed distance from the intersection 301, the car navigation system 10 reads out the road-vehicle communication flag "0" of the intersection 301 from the map information data, and based on the flag "0", recognizes that the area near the intersection 301 is a road-vehicle communication impossible area, and outputs, to the on-vehicle system 30, information that the own car 1 is approaching the intersection 301 and the area near the intersection 301 is a communication impossible area (step 54).

At the same time as the information indicating that the own car 1 is approaching the intersection 301 and the area near the intersection 301 is a communication impossible area being inputted from the car navigation system 10 (step S75), the on-vehicle system 30 outputs a stand-by start instruction to the on-vehicle communication equipment 20 (step S76).

In accordance with the stand-by start instruction inputted from the on-vehicle system 30, the on-vehicle communication equipment 20 transfers to a stand-by state (step S62). Then, when the own car 1 moves to P4, the on-vehicle communication equipment 20 receives, from the roadside communication equipment 25, information that the other car 3 is approaching from the crossing road at the intersection 301, and immediately outputs this information to the on-vehicle system 30 (step S63).

When information indicating that the other car 3 is approaching the intersection 301 is inputted from the on-vehicle communication equipment 20 (step S77), the on-vehicle system 30 causes the safety drive urging information to be displayed on the display 401, and also outputs, to the output device 40, an instruction for outputting a sound from the speaker 402 (step S78). The output instruction includes information indicating the entering state of the other car 3 approaching the intersection, that is, information indicating that the other car 3 is entering from the right direction, for example.

When the instruction is inputted from the on-vehicle system 30, the output device 40 displays "Intersection ahead, car is approaching from right direction" for example on the display 401 in accordance with the instruction, and outputs an alarm such as "bleep" for example from the speaker 402 (step S91), to thereby urge the driver to drive safely at the intersection 301, and ends processing at the intersection 300 and the intersection 301.

Then, since the intersection 301 is a road-vehicle communication possible area, the on-vehicle system 30 outputs, to the car navigation system 10, an instruction to update the road-vehicle communication flag of the intersection 301 written on the map information data from "0" to "1" (step S79).

Based on the instruction inputted from the on-vehicle system 30, the car navigation system 10 updates the road-vehicle communication flag of the intersection 301 written on the map information data from "0" to "1" as shown in FIG. 4 (step S55).

Then, the on-vehicle system 30 outputs a stand-by release instruction to the road-vehicle communication system 20 (step S80), and ends processing at the intersection 300 and the intersection 301.

Further, the on-vehicle communication equipment 20 releases the stand-by state in accordance with the stand-by release instruction inputted from the on-vehicle system 30 (step S64), and ends processing at the intersection 300 and the intersection 301.

According to the first embodiment, even if it is recognized that the on-vehicle communication equipment 20 cannot communicate with the roadside communication equipment, an instruction to output safety drive urging information is outputted to the output device 40 by the on-vehicle system 30. Therefore, it is possible to output information for urging safety driving to the driver in every intersection.

Further, according to the first embodiment, when the own car 1 reaches near an intersection, a stand-by start instruction is outputted to the on-vehicle communication equipment 20, and an instruction to output safety urging information is outputted to the output device 40, and then a stand-by release instruction is outputted to the on-vehicle communication equipment 20, by the on-vehicle system 30. Therefore, it is possible to suppress power waste consumed by the on-vehicle communication equipment 20.

Moreover, according to the first embodiment, the on-vehicle system 30 outputs instruction to output safety drive urging information to the output device 40 only when an object serving as a factor to urge safety driving near an intersection exists in travel condition information received from the roadside communication equipment. Therefore, in an intersection where safety driving is promised, it is possible to prevent outputting wasteful safety drive urging information.

Further, according to the first embodiment, if the communication state between the on-vehicle communication equipment 20 and the roadside communication equipment 100 recognized by the car navigation system 10 is different from the actual communication state between the on-vehicle communication equipment 20 and the roadside communication equipment 100, the road-vehicle communication flag of the map information data at the corresponding intersection stored is updated to a road-vehicle communication flag showing the actual communication state. Therefore, it is possible to improve the accuracy of the safety drive urging information to be outputted to the driver.

As described above, according to the first embodiment, in an area where communication with the roadside communication equipment 100 is possible, the travel conditions in the area can be obtained beforehand, so the driver can prepare for safety driving. On the other hand, even if communication with the roadside communication equipment 100 is impossible, it is possible to output a prescribed safety urging instruction to the driver before entering the communication area by the computation control function of the on-vehicle system (on-vehicle computation controller) 30, based on the communication availability information stored on the car navigation system (communication availability information storing unit) 10. Therefore, safety urging information is transmitted to the driver in any condition, so when the own car 1 is entering a communication area such as an intersection, the driver has already recognized the state or the driver is prepared for safety, so in such a point, the driver can comfortably drive safely.

Further, if communication with the roadside communication equipment 100 is impossible as described above, the on-vehicle system (on-vehicle computation controller) 30 is activated immediately so as to output safety urging information from the output device 40 to the driver of the own car 1 as described above. Thereby, the driver of the own car will further concentrate on safety driving since the state of the dangerous area such as an intersection where the driver is approaching is unknown. This provides an advantage that traveling concentrating on safety confirmation can be realized when passing dangerous areas including all intersections.

Second Embodiment

Figure 9:
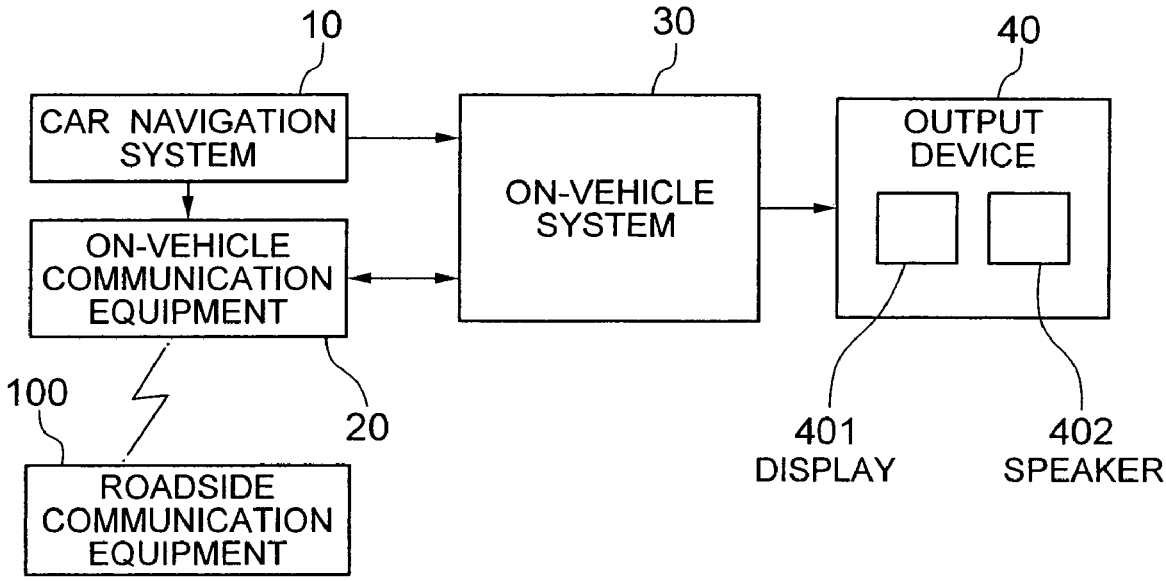
FIG. 9 is a block diagram showing a second embodiment according to the present invention.

FIG. 9 shows the configuration of a safety urging system for a self-propelled vehicle according to a second embodiment.

In FIG. 9, the safety urging system for a self-propelled vehicle is adapted to directly output a stand-by start instruction and a stand-by release instruction for setting whether to be in a preparing state (stand-by state) for receiving communication from the roadside communication equipment 100, from the car navigation system 10 to the on-vehicle communication equipment 20. In the other aspects, the system is same as that of the first embodiment described above.

Operation of the second embodiment will be described based on FIGS. 10 and 11.

Figure 10:
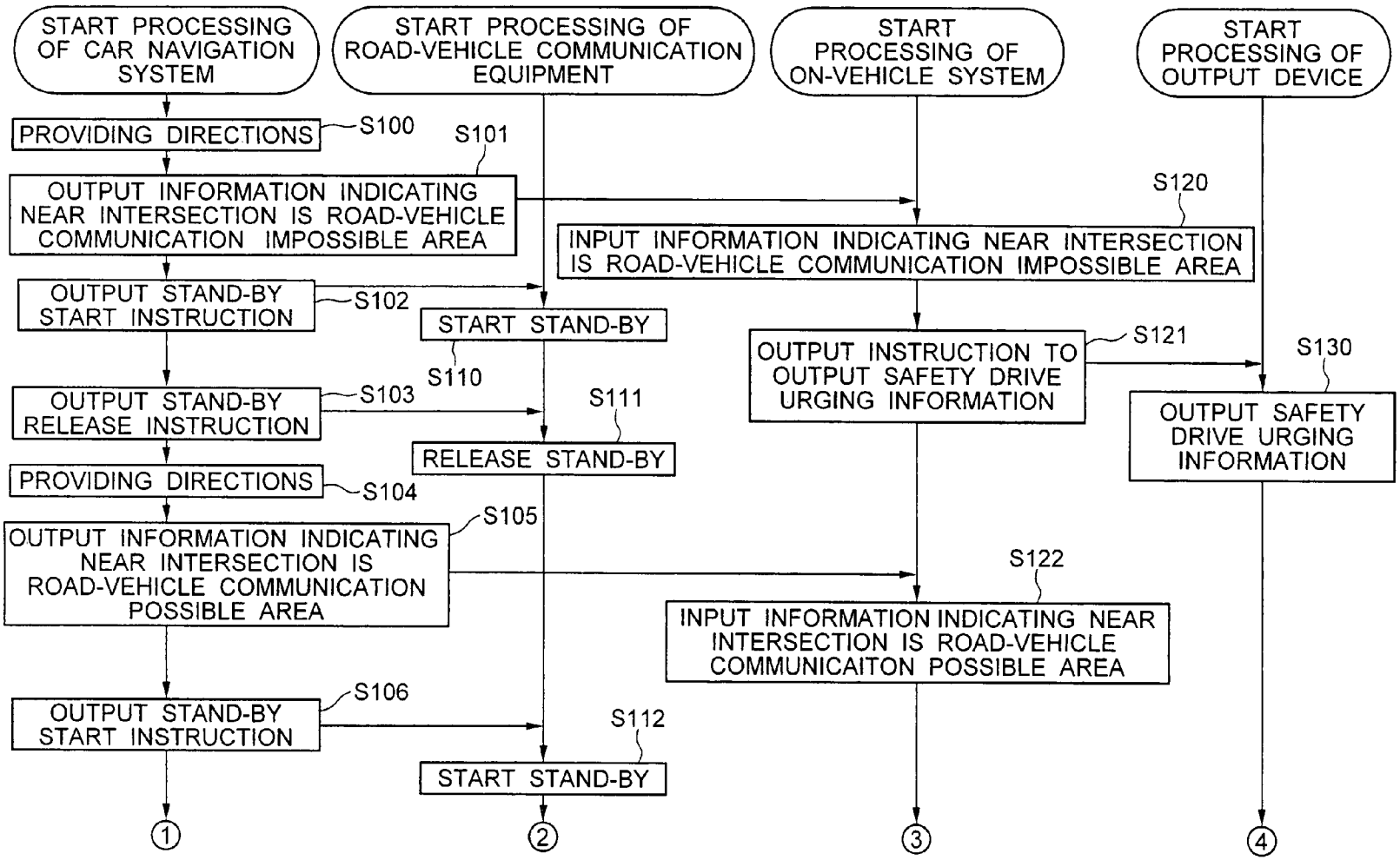
FIG. 10 is a flowchart showing operating timings of the respective units of the second embodiment disclosed in FIG. 9.
Figure 11:
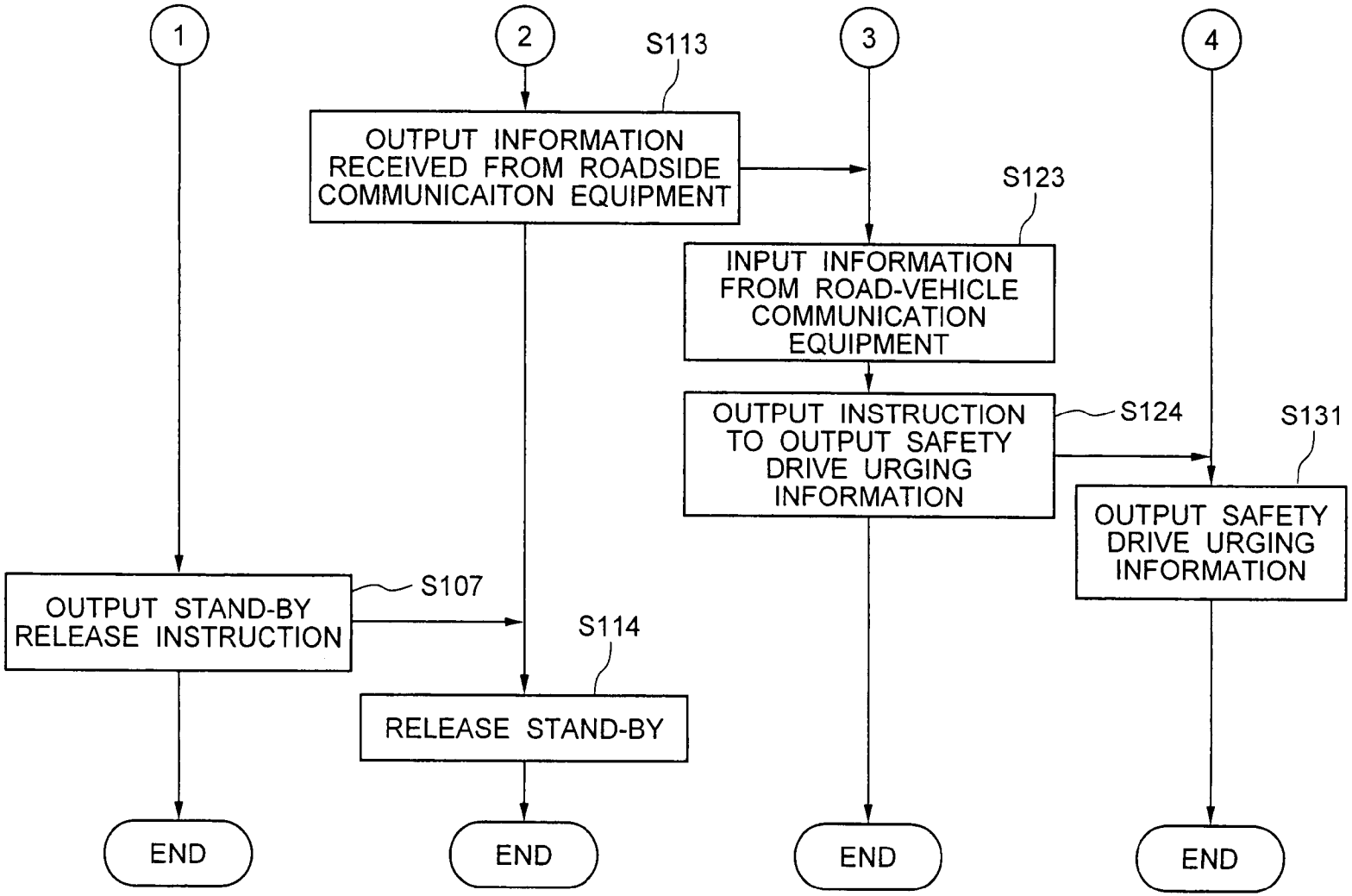
FIG. 11 is a flowchart showing operating timings of the respective units of the second embodiment continued from FIG. 10.

FIGS. 10 and 11 are flowcharts showing operation of the second embodiment.

In FIGS. 10 and 11, when the own car 1 is at P1, the car navigation system 10 displays route directions or the present location of the own car 1, based on the route search result previously set by the driver (step S100). Then, the car navigation system 10 moves to the intersection 300, and when it reaches the location having a prescribed distance from the intersection 300, it reads out the road-vehicle communication flag "0" of the intersection 300 from the map information data, and based on the flag "0", recognizes that the area near the intersection 300 is a communication impossible area. Then, the car navigation system 10 outputs, to the on-vehicle system 30, information indicating that it is approaching the intersection 300 and the area near the intersection 300 is a communication impossible area (step S101). Then, the car navigation system 10 outputs a stand-by start instruction to the on-vehicle communication equipment 20 (step S102).

When information indicating that the vehicle is approaching the intersection 300 and the area near the intersection 300 is a communication impossible area is inputted from the car navigation system 10 (step S120), the on-vehicle system 30 outputs, to the output device 40, an instruction to output a safety drive urging information to the driver when the own car 1 reaches the point P2 closer to the intersection 300 (step S121), since the road-vehicle communication service cannot be used at the intersection 300 where it is approaching.

When the instruction is inputted from the on-vehicle system 30, the output device 40 displays "Intersection ahead, take caution" for example on the display 401, and outputs an alarm such as "bleep" for example from the speaker 402, in accordance with the output instruction, to thereby urge the driver to drive safely (step S130). Thereby, the driver can drive while paying attention to the other car 2 approaching from the crossing rode at the intersection 300.

When a stand-by start instruction is inputted from the car navigation system 10, the on-vehicle communication equipment 20 transfers to be in a stand-by state in accordance with the instruction (step S110). Since the area near the intersection 300 is a communication impossible area, the on-vehicle communication equipment 20 will not start communication with the roadside communication equipment 100 actually.

Then, after passing the intersection 300, the car navigation system 10 outputs a stand-by release instruction to the on-vehicle communication equipment 20 (step S103).

Further, the on-vehicle communication equipment 20 releases the stand-by state in accordance with the instruction inputted (step S111).

Then, the own car 1 passes the intersection 300 and moves to P3. During the period, the car navigation system 10 displays route directions or the present location of the own car 1 based on the route search result previously set by the driver (step S104). Then, the car navigation system 10 moves to the intersection 301, and when it reaches a location having a prescribed distance from the intersection 301, it reads out the road-vehicle communication flag "1" of the intersection 301 from the map information data, and based on the flag "1", it recognizes that the area near the intersection 301 is a communication possible area. Next, the car navigation system 10 outputs, to the on-vehicle system 30, information indicating that the vehicle is approaching the intersection 301 and the area near the intersection 301 is a communication possible area (step S105). Then, the car navigation system 10 outputs a stand-by instruction to the on-vehicle communication equipment 20 (step S106).

Then, to the on-vehicle system 30, the information indicating that the vehicle is approaching the intersection 301 and the area near the intersection 301 is a communication possible area is inputted from the car navigation system 10 (step S122).

Further, when the instruction is inputted from the car navigation system 10, the on-vehicle communication equipment 20 becomes a stand-by state in accordance with the instruction (step S112). Then, when the own car 1 moves to P4 and enters the area, the on-vehicle communication equipment 20 receives information from the roadside communication equipment 100 indicating that the other car 3 is approaching from the crossing road at the intersection 301, and immediately outputs the information to the on-vehicle system 30 (step S113). Note that the on-vehicle communication equipment 20 will not transmit any information to the on-vehicle system 30 if there is no vehicle or pedestrian at this time.

When information indicating that the other car 3 is approaching the intersection 301 is inputted from the on-vehicle communication equipment 20 (step S123), the on-vehicle system 30 outputs, to the output device 40, an instruction to output safety drive urging information at the intersection 301 to the driver (step S124). The instruction includes information about the entering state of the other car 3 approaching the intersection, that is, information indicating that the other car 3 is entering from the right direction, for example.

When the instruction is inputted from the on-vehicle system 30, the output device 40 displays "Intersection ahead, car is approaching from right direction" for example on the display 401 in accordance with the instruction, and outputs an alarm such as "bleep" for example from the speaker 402 (step S131) to thereby urges the driver to drive safely at the intersection 301, and ends processing at the intersection 300 and the intersection 301.

After passing the intersection 301, the car navigation system 10 outputs a stand-by release instruction to the on-vehicle communication equipment 20 (step S107), and ends processing at the intersection 300 and the intersection 301.

The on-vehicle communication equipment 20 releases the stand-by state in accordance with the stand-by release instruction inputted from the car navigation system 10 (step S114), and ends processing at the intersection 300 and the intersection 301.

Other configurations and operational effects thereof are same as those of the first embodiment.

In this way, almost the same operational effects as those of the first embodiment can be achieved as well. Further, since a part of the operation of the on-vehicle communication equipment 20 is carried out based on information outputted from the car navigation system 10, responsiveness of the operation of the on-vehicle communication equipment 20 is improved. This provides an advantage that responsiveness is improved as a whole.

Third Embodiment

Figure 12:
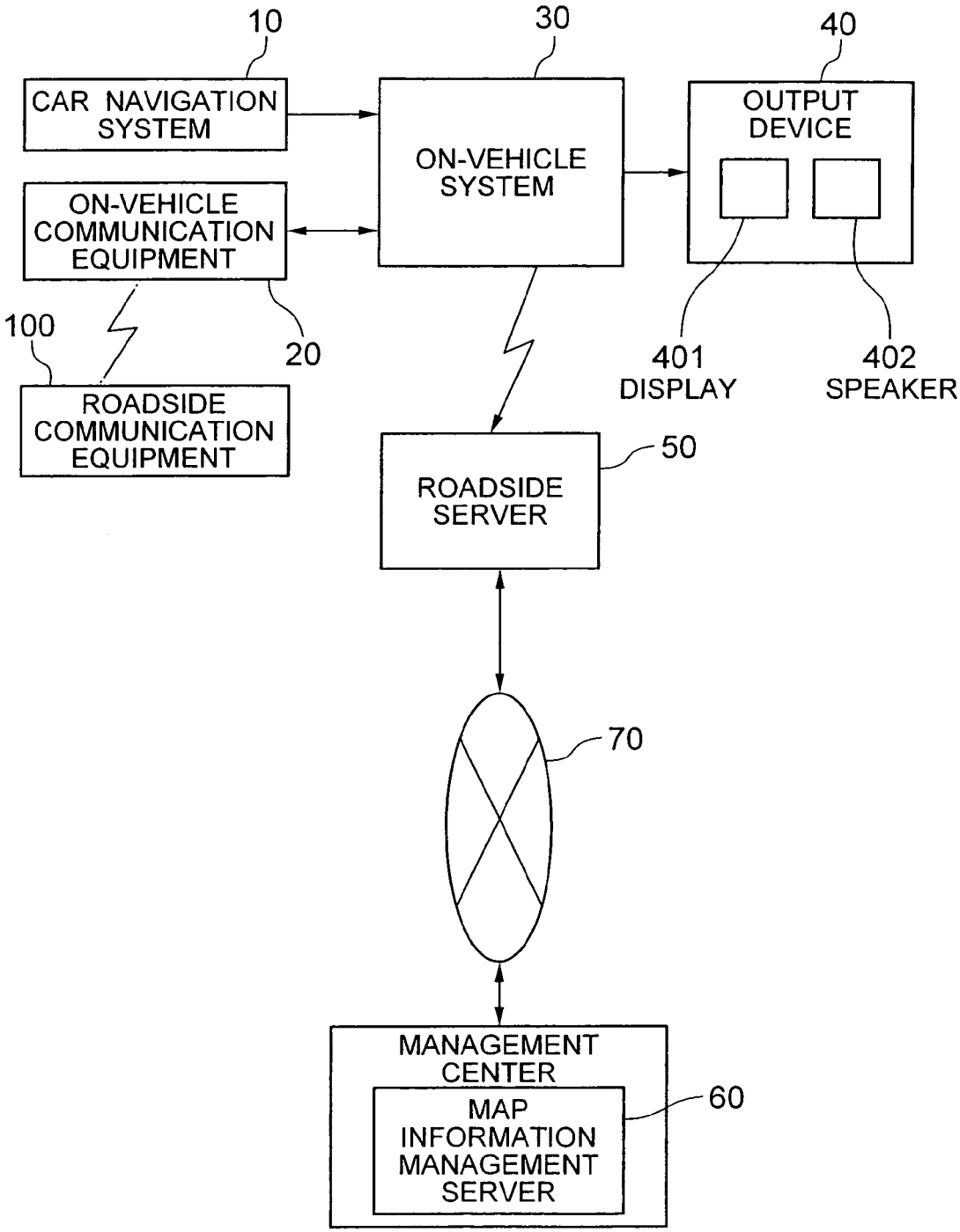
FIG. 12 is a block diagram showing the configuration of a road-vehicle communication system of a third embodiment according to the present invention.

FIG. 12 shows a third embodiment according to the present invention.

The third embodiment shown in FIG. 12 includes the car navigation system 10, the on-vehicle communication equipment 20, the on-vehicle system 30 and the output device 40, which work same as the case of the first embodiment. Further, in the safety urging system for a traveling vehicle according to the third embodiment, a roadside server 50 provided near an intersection which operates in accordance with a request from the on-vehicle system 30, and a central management server 60 provided in the central center, are also included.

The on-vehicle system 30 and the roadside server 50 are connected wirelessly via the on-vehicle communication equipment 20, and the roadside server 50 and the central management server 60 are connected via a communication line network 70.

The car navigation system 10, the on-vehicle communication equipment 20 and the output device 40 have the same functions as those of the first and second embodiments. On the other hand, the on-vehicle system 30 performs processing described below with the roadside server 50, so various functions required therefor are added. This will be explained below.

The on-vehicle system 30 outputs an instruction to update the map information data to the car navigation system 10, and then transmits, to the roadside server 50 via wireless communication, an instruction to update the road-vehicle communication flag of the map information data (hereinafter referred to as "management map information data") stored on the central management server 60. Further, when the on-vehicle system 30 receives the management map information data of an intersection, stored on the central management server 60 and updated, from the central management server 60 via the roadside server 50, the on-vehicle system 30 outputs an instruction to update the map information data corresponding to the received management map information data to the car navigation system 10. This instruction includes update contents.

When the roadside server 50 receives the instruction from the on-vehicle system 30, the instruction is transmitted to the central management server 60 via the communication network 70. Further, the roadside server 50 receives the management map information data from the central management server 60 via the communication line network 7, and transmits the received management map information data to the on-vehicle system 30 through wireless communication.

The central management server 60 stores the management map information data on a memory (not shown). As shown in FIG. 13, the management map information data includes road-vehicle communication flags, for respective intersections, as shown in FIG. 2 and FIG. 8, indicating availability of communication between the roadside communication equipment 100 provided at an intersection or near an intersection and the on-vehicle communication equipment 20 (hereinafter, referred to as "road-vehicle communication availability"), signal flags indicating presence of signals and the like, and the number of update instructions of the management map information data inputted from the on-vehicle system 30.

When the central management server 60 receives an instruction requesting an update of the road-vehicle communication flag of an intersection number from the on-vehicle system 30 via the roadside server 50, it updates the road-vehicle communication flag of the corresponding intersection number written on the management map information data, in accordance with the instruction. For example, if the number of times in the management map information data of the intersection 301 before update is "14", it is updated to "15" where the number "1" is added, as shown in FIG. 13.

Further, if the number of times of the management map information data updated as described above is a prescribed number, that is, "15" for example, the central management server 60 transmits the management map information data of the corresponding intersection number to the on-vehicle system 30 via the communication line network 70 and the roadside server 50.

According to the present embodiment, the central management server 60 manages the management map information data collectively, and when the number of times of the update instructions reaches a prescribed number of times, it is possible to cause the vehicle to amend the map information data. From this point, it is possible to improve the accuracy of the safety drive urging information outputted to the driver at intersections.

In the respective embodiments described above, although specific communication areas of the invention have been described by showing intersections as examples, the present invention does not necessarily limit the specific communication areas as intersections. For example, by providing the roadside communication equipment 100 at a blind curved area, an area where the road surface is easily frozen in winter or the like, so as to provide a road-vehicle communication availability area at a curved part or the like on the map of the car navigation system same as the case of an intersection, an alarm signal can be outputted same as the case of an intersection. Thereby, the driver driving the dangerous area is urged to drive safely.

As described above, the present invention is configured such that road-vehicle communication availability areas are provided in map information of a car navigation system widely used or the like, and by reading the information beforehand, it is intended to use the system effectively and to provide services for not lowering cautions of the driver. The respective embodiments described above are adapted to realize it.

Therefore, according to the respective embodiments, the road-vehicle communication service availability of an area where the vehicle is to enter can be previously obtained from map information of a car navigation system or the like, and by utilizing the information of the road-vehicle communication service availability provided previously, it is possible to make provision of information to the driver optimum. Further, by utilizing the information of the road-vehicle communication service availability provided previously, an operation control of the on-vehicle communication equipment 20 can be carried out effectively. Further, by utilizing information of the road-vehicle communication service availability provided previously, if the content thereof is different from the map information of the car navigation system or the like, it is possible to update the map information.

In this way, according to the respective embodiments described above, with the safety support by the safety urging system for a traveling vehicle described above, the driver can receive services at locations where the load-vehicle communication services are provided. Further, in locations where the road-vehicle communication services are not provided, cautions by the driver himself/herself are increased, and in particular, since no alarm is given by the own car at such locations, the tension of the driver is enhanced, so conditions of distraction are reduced.

Further, in the respective embodiments, the on-vehicle communication equipment 20 is not always in a communicating state but is to be in a stand-by state before entering a road-vehicle communication area. Therefore, power consumption by the on-vehicle communication equipment 20 can be greatly reduced. Further, the respective embodiments are so configured that if information of road-vehicle communication service availability is different from that of map information, the map information can be updated. Therefore, the present invention has such an excellent effect as to be able to improve the reliability of the system for road-vehicle communication service availability to the driver.

INDUSTRIAL APPLICABILITY

The present invention is also applicable to construction machinery in a construction site if it is so configured as to detect a worker coming close thereto and to alert the driver.

What is claimed is:

1. A safety urging system for a self-propelled vehicle, comprising:

an on-vehicle communication unit which communicates with roadside communication equipment provided in a predetermined communication area on a road where a vehicle travels, and inputs information about traffic condition in the communication area;

a safety urging information output unit which outputs information to urge a driver of the own vehicle to drive safely based on the information obtained by the on-vehicle communication unit;

an on-vehicle computation controller which controls operations of the safety urging information output unit and the on-vehicle communication unit; and a communication availability information storing unit which previously stores communication availability information indicating whether communication by the on-vehicle communication unit with the roadside communication equipment is possible, together with map information including the communication area, wherein the on-vehicle computation controller includes:

a communication availability recognizing function, activated when the own vehicle reaches near the communication area, to determine whether communication between the on-vehicle communication unit and the roadside communication equipment is possible based on communication availability information, and an operation instruction output function, activated when communication with the roadside communication equipment is impossible, to send an operation instruction to the safety urging information output unit.

2. The safety urging system for a self-propelled vehicle, as claimed in claim 1, wherein the communication area is a predetermined range on a road including an intersection.

3. A safety urging system for a self-propelled vehicle, comprising:

an output device serving as a safety urging information output unit which outputs safety urging information to urge safety driving at an intersection to the driver of the own vehicle;

an on-vehicle communication unit which inputs information about travel condition near the intersection, from a roadside communication equipment previously provided to an area of the intersection;

a car navigation system having a communication availability information storing function to previously store communication availability information indicating whether the on-vehicle communication unit is capable of communicating with the roadside communication equipment, for each intersection, and an on-vehicle computation controller, activated when the own vehicle reaches near an intersection, which determines whether the on-vehicle communication unit is capable of communicating with the roadside communication equipment with reference to the communication availability information stored on the car navigation system, wherein the on-vehicle computation controller has an operation instruction output function, which works when communication between the on-vehicle communication unit and the roadside communication equipment becomes impossible, to send an operation instruction to the output device.

4. The safety urging system for a self-propelled vehicle, as claimed in claim 1, wherein if information indicating travel condition received from the roadside communication equipment is information indicating that an object serving as a factor to urge safety travel exists near the communication area including the intersection, the on-vehicle computation controller has an operation instruction output function to output an operation instruction to an output device serving as the safety urging information output unit.

5. The safety urging system for a self-propelled vehicle, as claimed in claim 1, wherein the on-vehicle computation controller includes:

a stand-by instruction output function, activated when the own vehicle reaches near an intersection, to output to the on-vehicle communication unit an instruction to set to a stand-by state before starting communication with the roadside communication equipment, and a stand-by state releasing function to activate the operation instruction output function so as to output an operation instruction to the output device, and to release the stand-by state of the on-vehicle communication unit so as to restore to a state before stand-by, when a communication impossible state is caused with the roadside communication equipment.

6. The safety urging system for a self-propelled vehicle, as claimed in claim 1, wherein if a communication state including communication availability, newly recognized by the communication availability recognition unit, between the on-vehicle communication unit and the roadside communication equipment is different from a communication state including communication availability, previously set, between the on-vehicle communication unit and the roadside communication equipment, the on-vehicle computation controller has a communication state update function to update the communication availability information stored on the communication availability information storing unit to a new communication state between the on-vehicle communication unit and the roadside communication equipment.

7. A safety urging method for a self-propelled vehicle, comprising:

a first step to take information about travel condition in a predetermined communication area on a road where a vehicle travels, from roadside communication equipment provided in the communication area into an on-vehicle communication unit previously mounted in the own vehicle;

a second step to output prescribed safety urging information to a driver of the own vehicle, based on traffic information obtained from the roadside communication equipment or information previously set separately;

a communication availability recognition step in which before the first step is carried out, an on-vehicle computation controller is activated when the own vehicle reaches near the communication area, and the on-vehicle computation controller previously mounted determines whether the on-vehicle communication unit is capable of communicating with the roadside communication equipment, with reference to communication availability information stored on a communication availability information storing unit previously mounted; and an operation instruction output step in which before or after the first step is carried out, if it is determined that communication with the roadside communication equipment is impossible, the on-vehicle computation controller is activated so as to send an operation instruction to output safety urging information to a safety urging information output unit previously mounted.

8. A safety urging method for a self-propelled vehicle, comprising:

a first step to take information about travel condition in a predetermined communication area including an intersection on a road where a vehicle travels, from roadside communication equipment provided in the communication area into an on-vehicle communication unit previously mounted in the own vehicle;

a second step to output prescribed safety urging information to a driver of the own vehicle, based on traffic information obtained from the roadside communication equipment or information previously set separately;

a stand-by instruction output step in which before the first step is carried out, the on-vehicle computation controller is activated when the own vehicle reaches near the communication area so as to output an instruction to set the on-vehicle communication unit to be in a stand-by state which is a state before starting communication with the roadside communication equipment; and a stand-by state releasing step in which before or after the first step is carried out, if a communication impossible state is recognized with the roadside communication equipment, the on-vehicle computation controller is activated so as to carry out the second step and to release the stand-by state of the on-vehicle communication unit to thereby restore to a state before stand-by.

9. A safety urging method for a self-propelled vehicle, comprising:

a first step to take information about travel condition in a predetermined communication area including an intersection on a road where a vehicle travels, from roadside communication equipment provided in the communication area into an on-vehicle communication unit previously mounted in the own vehicle;

a second step to output prescribed safety urging information to a driver of the own vehicle based on traffic information obtained from the roadside communication equipment or information previously set separately;

a communication state determination step in which an on-vehicle computation controller, mounted separately, determines whether a communication state including communication availability taken in the first step is different from a communication state including communication availability between the on-vehicle communication unit and the roadside communication equipment stored on a communication availability information storing unit previously mounted; and a communication state update step in which when the communication state taken in the first step is determined as being different from the communication state previously set, the communication availability information stored on the communication availability information storing unit is updated to the communication state taken in the first step.

10. A safety urging information processing program stored on a computer readable medium for causing a computer to execute:

travel information obtainment processing to take information about travel condition in a predetermined communication area including an intersection on a road where a vehicle travels, from roadside communication equipment set in the communication area into an on-vehicle communication unit previously mounted in the own vehicle;

urging information output processing to output predetermined safety urging information to a driver of the own vehicle, based on traffic information obtained from the roadside communication equipment or information previously set separately;

communication availability recognition processing in which when the own vehicle reaches near the communication area before the travel information obtainment processing is executed, it is determined whether the on-vehicle communication unit is capable of communicating with the roadside communication equipment, with reference to communication availability information stored on a communication availability information storing unit previously mounted; and operation instruction output processing to, if communication with the roadside communication equipment is determined as impossible, send an operation instruction to a safety urging information output unit, previously mounted, to output safety urging information.

11. The safety urging information processing program, as claimed in claim 10, for further causing a computer to execute:

stand-by instruction output processing which is operated when the own vehicle reaches near the communication area so as to output an instruction to set the on-vehicle communication unit to be in a stand-by state which is a state before starting communication with the roadside communication equipment; and stand-by state release processing to, if it is determined that communication with the roadside communication equipment is impossible, output an instruction to release the stand-by state of the on-vehicle communication unit to thereby restore to a state before stand-by.

12. The safety urging information processing program, as claimed in claim 10, for further causing a computer to execute:

communication state determination processing to determine whether a communication state including communication availability processed in the travel information obtainment processing is different from a communication state including communication availability, stored on a communication availability information storing unit previously mounted, between the on-vehicle communication unit and the roadside communication equipment; and communication state update processing which is activated when the communication state is determined as being different from the communication state previously set through the communication state determination processing so as to update the communication availability information stored on the communication availability information storing unit to the communication state processed in the travel information obtainment processing.

* * * * *